US005775633A

United States Patent [19]

Zane

[11] Patent Number: 5,775,633

[45] Date of Patent: Jul. 7, 1998

[54] WALLPAPER BORDER ROLL HOLDER

[75] Inventor: Arthur Zane, 3800 20th St. N., St. Petersburg, Fla. 33714

[73] Assignee: Arthur Zane, St. Petersburg, Fla.

[21] Appl. No.: 699,537

[22] Filed: Aug. 19, 1996

[51] Int. Cl.[6] ..... B65H 16/02

[52] U.S. Cl. ..... 242/599.1; 242/599.3; 156/577

[58] Field of Search ..... 242/588, 598, 242/598.3, 598.5, 599, 599.1, 599.3, 599.4, 597.7, 406; 156/577, 574

[56] References Cited

U.S. PATENT DOCUMENTS

| | | | |
|---|---|---|---|
| 2,480,461 | 8/1949 | Gabrielson | 242/599 |
| 2,614,770 | 10/1952 | Gabrielson | 242/598.5 |
| 3,319,904 | 5/1967 | Camlet | 242/406 |
| 3,844,500 | 10/1974 | Krause | 242/597.7 |
| 4,101,088 | 7/1978 | Stauth | 242/406 |
| 5,328,543 | 7/1994 | Campagna | 156/577 |
| 5,497,958 | 3/1996 | Orf et al. | 242/406 |
| 5,573,630 | 11/1996 | Edney et al. | 156/577 |

*Primary Examiner*—John M. Jillions
*Attorney, Agent, or Firm*—Arthur Zane

[57] ABSTRACT

This tool is an improved applicator for holding wallpaper border material at the ceiling wall juncture during application to a wall. The tool consist of a handle, a rotating shaft and a shelf to support the roll of border material and includes a fixed bottom spike and a spring loaded top spike for securing the tool to the ceiling/wall construction. The applicator positions himself at the top of a ladder to proper working height and dispenses the border paper along the application area. When he has reached as far as arms length he secures the tool to the ceiling and wall by engaging the spikes into the ceiling and wall, thus freeing both hands to apply the adhesive and align the border along the top of the wall. The tool is left in place when he descends the ladder to move it to the next location . Thus, the border holding tool is in optimum location for him to unroll the next length and secure the tool and border roll further down the line of application.

1 Claim, 1 Drawing Sheet

WALLPAPER BORDER ROLL HOLDER

FIELD OF THE INVENTION

Figure 1:
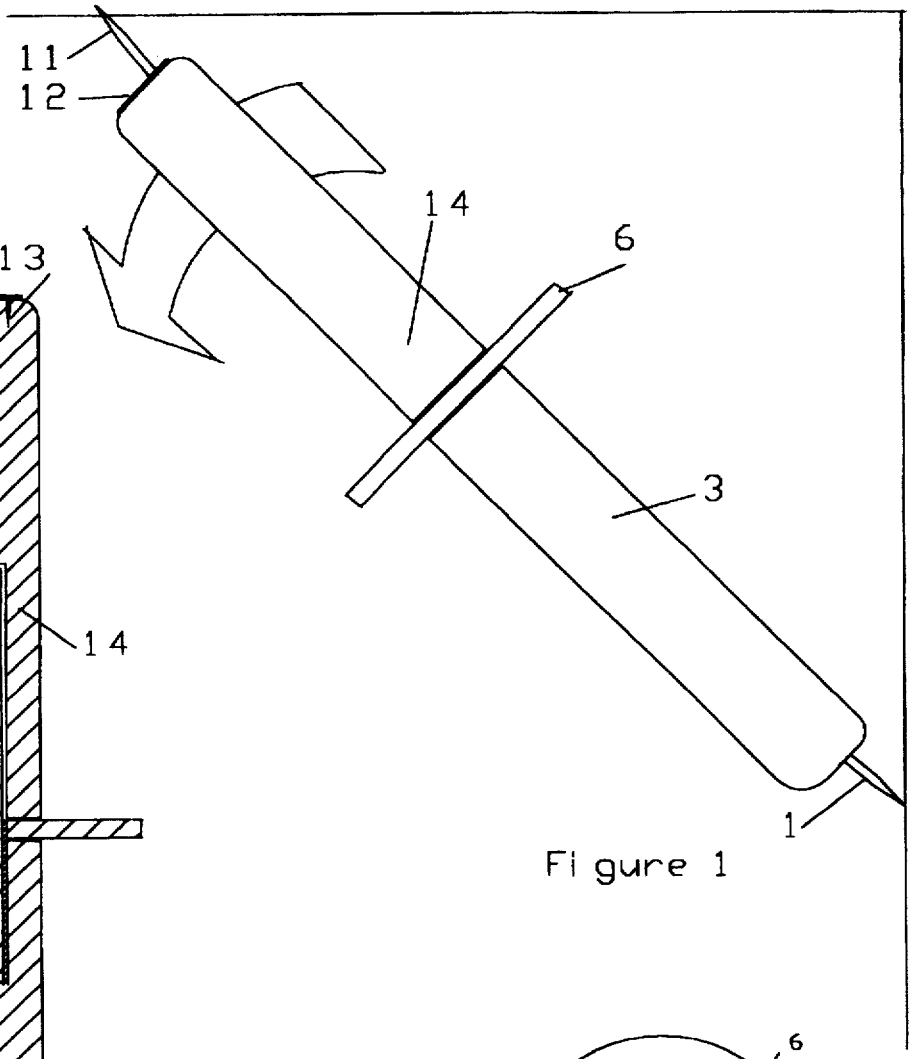

The present invention relates generally to wallpaper application and specifically to an improved applicator for wallpaper borders.

BACKGROUND OF THE INVENTION

Wallpaper borders are normally applied along the ceiling-wall juncture and are difficult to place continuously . A single person has difficulty holding the border roll while trying to apply the adhesive . In order to secure the border in place a method of holding the roll of border material in alignment to prevent pulling on the material already applied to the wall is helpful and expedites the application process. Another alternative is to cut the border material into manageable lengths, but this often results in unsightly laps and joints.

Others have attempted to solve this problem with a variety of tools designed to dispense the paper at ceiling height.

The dispensing of roll materials. The U.S. Pat. No. 2,480,461 to Gabrielson shows a wire and fabric reel designed for a variety of mountings. This patent shows a rotating platform for holding material mounted on a shaft with several different methods of securing the top and bottom of the shaft. However in order to dispense a wallpaper border roll along the ceiling line it would require an 8' long pole or shaft. This is space consuming and awkward to transport .

U.S. Pat. 2,614,770 to J. B.Gabrielson for a building construction roll supporting reel is designed to dispense a variety of roll materials from a rotating shaft that can be connected to building elements . This patent also requires a long shaft to reach the ceiling line, and it takes up much room and is awkward to transport.

U.S. Pat. No. 3,319,904 to J. V. Camlet for a tool construction uses a rotatable shaft with a fixed spike at one end and a spring loaded spike on the opposite end to provide a means of mounting the shaft between two fixed surfaces for the the purpose of dispensing roll material. It does not provide a shelf for the support of a roll of wallpaper border material, and if secured between the wall and ceiling would allow the roll to slip to the bottom of the shaft and jamb itself between the shaft and the wall.

U.S. Pat. No. 3,844,500 to Krause for a support for roll of paper and other articles is a rotatable shaft that is designed to be mounted on a towel rack or other form of tubular shaft. It cannot be secured between the ceiling- wall juncture in a manner that would allow temporary placement without attaching to a substantial pipe or rod .

U.S. Pat. No. 4,101,088 to Stauth for a manual impact stake driving apparatus combines a stake with a rotatable shaft with platforms. However this patent lacks a second spike to allow it to be attached compressively between two rigid surfaces It depends solely upon the securement of its bottom stake into a material to hold it in place.

U.S. Pat. No. 5,328,543 to Campagna, and a border applicator sold under the trademark BORDERMATE, SOLD BY Paint Sundry Products Inc, of Mississauga, Ontario, Canada, have attempted to provide a solution for these problems. The U.S. Patent shows a pole and canister system for applying wallpaper borders. A cupshaped canister with a lid is mounted at the top of the shaft. The shaft extends into the canister , which holds the border roll. A vertical slit in the canister allows the border paper to be dispensed. One person is able to apply the border by propping the pole against the wall and moving it along as the application progresses.

This patent requires considerable space to store the pole when the unit is not in use, and when it is being transported. It will need to be approximately wall height, and may leak water or paste from the canister slit under some conditions.

U.S. Pat. No. 5,497,958 to Orf et al for a fencing material dispenser that is a ground supported spindle with attached guy wires is a roll material dispensing device that is secured at its base to the ground by penetrating spikes and secured at the top by guy wires.

However, it would require a long pole to reach the ceiling, would take a large storage space, and its platform for holding the roll material is situated at the bottom rather than the top end of the pole, where it would be needed to dispense border paper.

U.S. Pat. No. 5,573,830, to Edney et al. discloses a wallpaper applicator moving a cup shaped member mounted on a pole which dispenses wallpaper border material However, it is mounted on a ceiling height pole that is long and thereby difficult to transport and store.

Paint Sundry Products , Inc. sells a wallpaper border applicator under the trademark BORDERMATE which to the device described in U.S. Pat. No 5,328,543 The Bordermate uses a canister mounted on an adjustable flange to align the bottom of the roll of border paper with the the bottom of the slit. However it requires a long tubular pole to rest on the floor and requires a relatively large degree of storage area and can be awkward to transport.

The present invention broadly provides an applicator for a wallpaper border roll that consists of a spindle with flanged shelf to hold the roll of border paper. It can be directly secured to the ceiling and wall and moved along as the work progresses. It does not require a long pole and is more portable than the earlier referenced tools and requires less space for storage.

C. Summary:

This tool enables one person to hang a wallpaper border strip, normally supplied in rolls, without having to cut the material into short lengths so he can control each end of the strip. When adhesive has been applied to the border material it becomes heavy and will sag and pull itself loose from the wall unless the unglued end is supported. This becomes difficult if not impossible to do when the worker must climb down the ladder to move the border roll another arm's length down the wall. This tool enables him to leave the roll of border material at the last point the border is glued . When the worker ascends the ladder the tool with border roll is waiting for him at his new starting point. He can then unroll the maximum length of border strip he can glue to the wall and reattach the tool near the wall/ceiling intersection and start the entire maneuver over again.

The tool can be made of metal, plastic, wood, or any other material that can be shaped into the forms indicated in the drawings and that is rigid enough to hold the weight of the border roll without significant deflection. It consist of two cylindrical shafts in alignment along their long axes and held loosely together with a dowel . The dowel is fixed in one shaft, but left unsecured in the second shaft so that it is free to rotate around the long axis. At the juncture of the two shafts a flat circular shelf is secured that will provide a support for a roll of border strip material which will be free to rotate around the shaft.

REFERENCE TO THE DRAWINGS

FIG. 1: Shows the border roll holder as it would be positioned against the ceiling and wall. The roll of border material would be placed over the top half of the tool, which would be free to rotate and feed the material as demanded.

Figure 2:
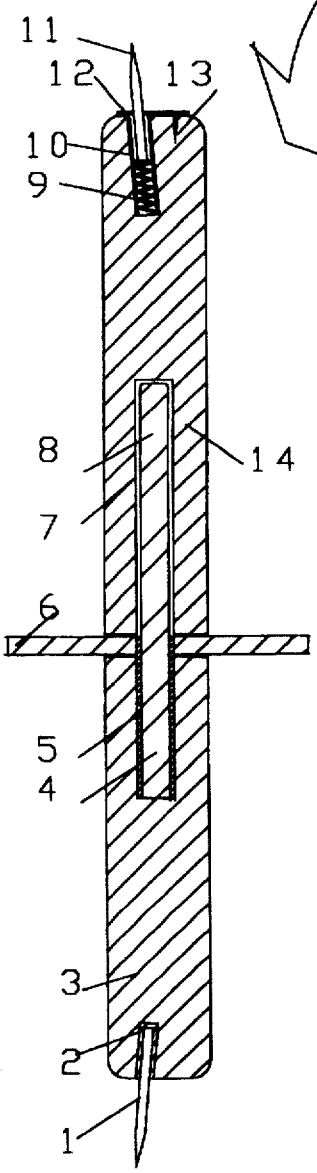

FIG. 2: A cross sectional view showing the parts of the tool.

Figure 3:
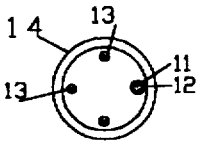

FIG. 3: an end view of the top plate which secures the spring loaded spike in place.

Figure 4:
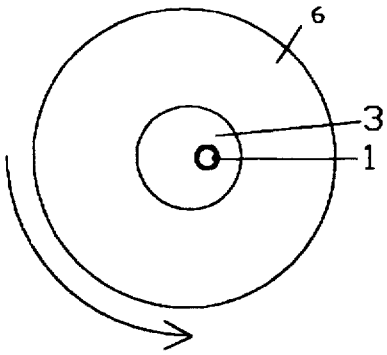

FIG. 4: an end view from the top showing the relative locations of the spike, rotating shaft, and border roll shelf.

DISCLOSURE OF THE INVENTION

This tool is a holder with a shelf (6) to hold a roll of wallpaper border material. The shelf (6) is attached to the top half of the holder (14) in the form of an elongated shaft member (14) which is free to rotate around the long axis(4) which is a dowel (8) secured in place by adhesive ( 5) along the centerline (of the bottom handle and to the shelf (6). The top half of the holder is provided with a hole (7) to receive the dowel allowing the top and bottom portions to rotate in respect to their long axis. The bottom half (3) of the holder provides a handle. Both the top and bottom ends of the tool are fitted with fine,sharp spikes (1) (11) which can be stuck into the ceiling or wall surface to retain the tool in place. The top spike (11) is spring loaded (9) so that it can retract into a tube (10) set into the shaft (14). A plate (12) attached to the top of the holder with fasteners (13) holds the moveable spike in place by means of a flange at the inside end. This allows the tool to first be spiked into the ceiling, and then be depressed so it can be stuck into the wall. The spring maintains enough compression in the spikes to insure that the tool will remain in place and can be applied without scraping the wall or ceiling surface. The length of the tool will be adequate to allow a diagonal distance sufficient to support a roll of wallpaper border material clear of both the wall and ceiling surfaces. The tool can be removed from place by depressing the top spike back (1) into the holder (14) allowing the wall spike to pull clear. At this point the tool can be swung loose from its attachments and moved to its new location where it will be reattached at the ceiling wall junction. The angle of attachment will approximate a 45 degree angle, but is not critical. The wallpaper border roll can be removed and/or replaced by sliding it over the top half of the holder until it rest on the shelf.

I claim:

1. A wall paper border supporting device comprising an elongated shaft member having bottom and top shaft portions, a dowel extending from the bottom shaft portion and into an opening in the top shaft portion to rotatably support the top shaft portion for rotation with respect to the bottom shaft portion, a shelf supported by the dowel between the bottom and top shaft portions for rotatably supporting a roll of wallpaper border, a fixed spike extending from the bottom shaft portion and a spring loaded spike extending from the top shaft portion, wherein a roll of wallpaper can be supported on the elongated shaft member for dispensing of the wallpaper while the shaft member is temporarily mounted between a wall and ceiling by the spikes extending from the shaft member.

* * * * *